United States Patent [19]

Rowe

[11] Patent Number: 5,067,383

[45] Date of Patent: Nov. 26, 1991

[54] DRIVE ADAPTER FOR FIREARM CARTRIDGE RELOADER

[75] Inventor: Ransom Rowe, Sarasota, Fla.

[73] Assignee: K&R Manufacturing, Inc., Hasting-on-Hudson, N.Y.

[21] Appl. No.: 638,758

[22] Filed: Jan. 8, 1991

[51] Int. Cl.[5] ..... F42B 33/02

[52] U.S. Cl. ..... 86/23; 86/24

[58] Field of Search ..... 86/23, 25, 28, 29, 31, 86/33, 37, 24, 1.1

[56] References Cited

U.S. PATENT DOCUMENTS 3,150,558 9/1964 Welch ..... 86/23

3,336,829 8/1967 Lee ..... 86/23

3,857,319 12/1974 Welch ..... 86/23

*Primary Examiner*—Charles T. Jordan

*Assistant Examiner*—J. Woodrow Eldred

*Attorney, Agent, or Firm*—Blodgett & Blodgett

[57] ABSTRACT

The drive adapter for a conventional hand operated firearm cartridge reloader that includes a drive shaft which is oscillated about its central longitudinal access to provide the actuating functions for the reloader. The drive adapter is operatively connected to the drive shaft of the reloader for oscillating the reloader. The drive adapter includes a fluid pump, a double acting fluid oscillator which has an output shaft and a coupler for operatively connecting the output shaft of the oscillator to the drive shaft of the reloader.

11 Claims, 2 Drawing Sheets

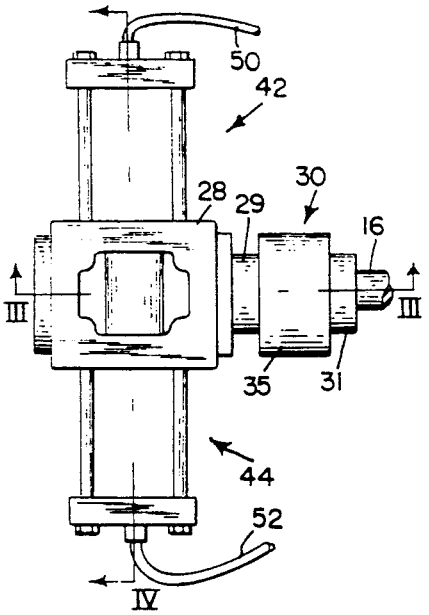
FIG. 2
FIG. 3
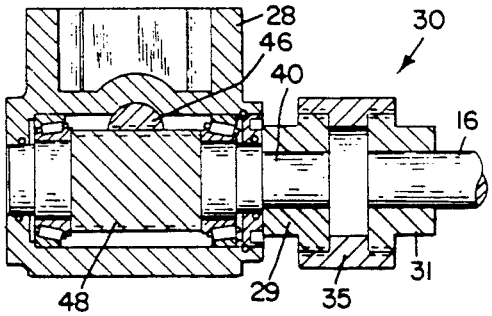
FIG. 1
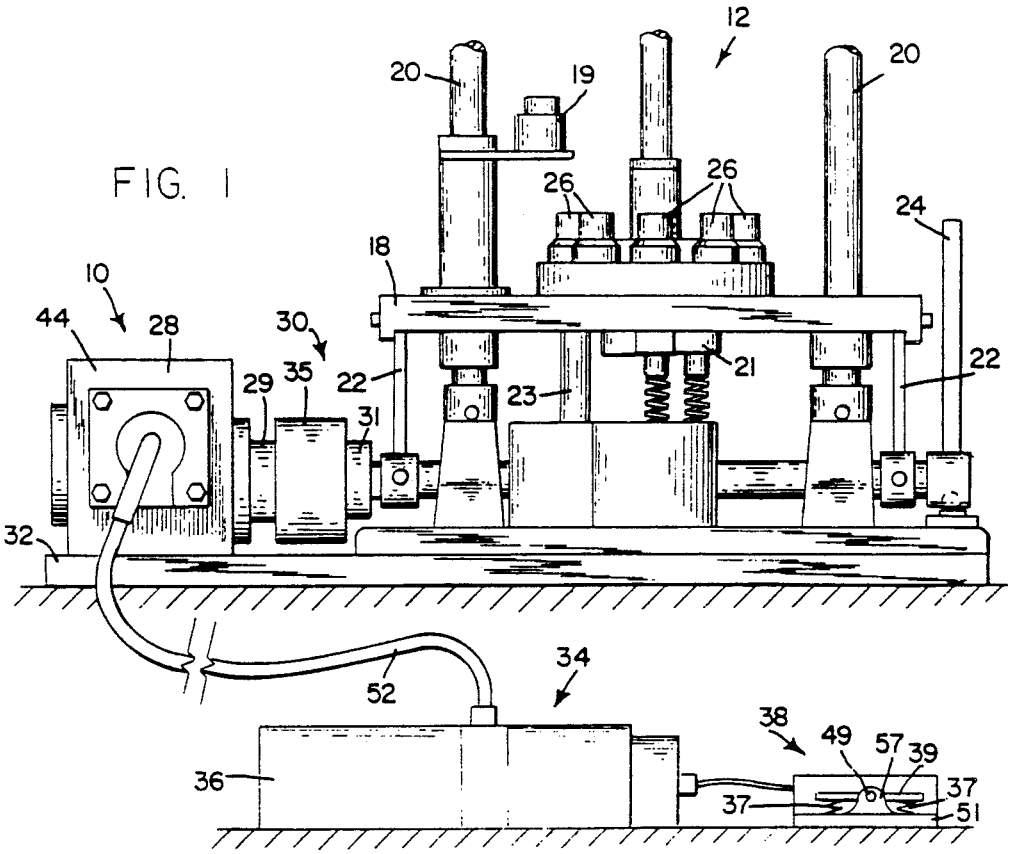

FIG. 4
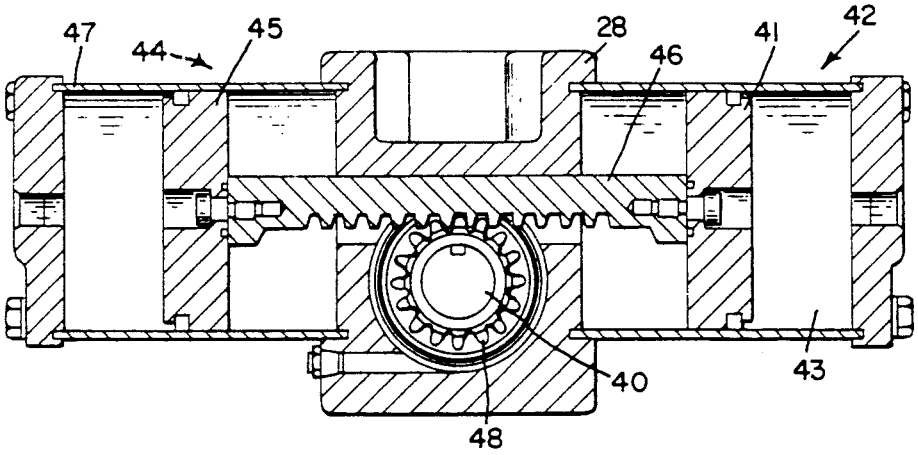
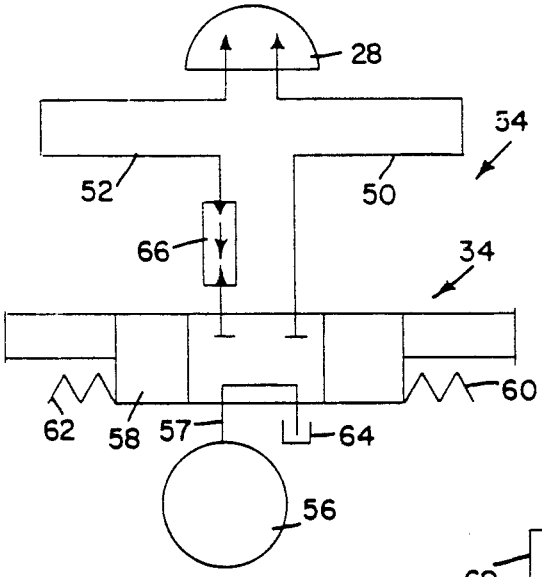
FIG. 5
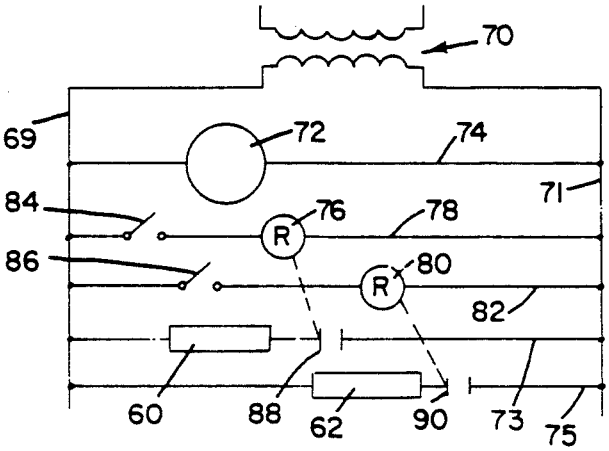
FIG. 6

DRIVE ADAPTER FOR FIREARM CARTRIDGE RELOADER

BACKGROUND OF THE INVENTION

The present invention relates to an adapter for providing power to a conventional hand operated reloader for firearm cartridges. Most competitive shooters own a hand operated reloader for several reasons. First of all, it is much easier to maintain quality control by loading one's own shells. Through trail and error a shooter decides on an optimum powder charge for his or her personal preference and then makes sure that each cartridge which is reloaded contains that particular charge. Secondly, there is a considerable financial savings by reloading cartridges, particularly shot gun shells for trap shooting. A great number of cartridges are fired during each competitive event. If the shooter enters several events a year, the savings from reloading justifies the cost of the reloader. The cost of the reloader is recouped in savings in a relatively short time. Most shooters start with a relatively simple and inexpensive reloader and gradually move up to more expense and complex reloaders. For very serious shooters, the added expense of a complex reloader is justified by the savings. In addition to the savings, production of reloaded shells becomes a significant factor when large numbers of cartridges are involved. The shooter finds that he or she spends more time reloading cartridges than discharging them during competitions. For shotgun shells, reloading involves eight separate operations. This time factor is eased considerably by using sequential reloader which performs all eight operations simultaneously. The eight operations are performed on eight different shells which are processed sequentially. The reloader has eight station fixtures on a fixed base and eight complimentary lower fixtures omn a movable base. In addition, the lower fixtures which carry the shells are indexed progressively from vertical alignment with one station into vertical alignment with next station in the sequence. The movable base is moved toward and from the fixed base by a crank mechanism which is driven by the oscillation of a horizontal drive shaft. The drive shaft is oscillated by an elongated hand operated lever. An empty shell is positioned on a starting fixture when the movable base is in the up position. When the movable base is lowered, the empty shell projects into the first lower fixture. At this point, a wad is placed in a wad fixture which swing into alignment between a pair of complimentary upper and lower fixtures when the movable base is again raised. When the movable base is raised, the first shell is indexed into vertical alignment with the second station and a second shell is positioned on the starting fixture. Another oscillation of the drive shaft causes the second step to be performed on the first shell and the first step to be performed on the second shell. The first shell then moves beneath the third station, the second shell moves beneath the second station and a third shell is added to the starting fixture. As the shells progress from station to station, additional empty shells are added to the starting fixture of the reloader. When all of the fixtures of the movable base are occupied with shells, for each subsequent oscillation of the drive shaft, a completed cartridge is automatically removed from the reloader and a empty shell is added to the starting fixture. The sequential loader increases reloading productivity considerably but a considerable amount of time is still spent in reloading, probably as much time as shooting. There had been attempts to provide power to hand operated reloaders with limited success. In some cases a hand operated reloader is permanently converted into a power driven machine which takes a considerable amount of time to accomplish so that the shooter does not have the use of the reloader during the conversion. All attempts to provide a drive unit which can be attached to the reloader by the shooter had been unsuccessful. Brute power is not enough many of the operations are delicate and must be performed with controlled power. In some cases hydraudlic actuators are applied directly to the movable base for vertically reciprocating the base. This approach has met with limited success. Since the reloader is designed for actuation by the oscillation of the drive shaft providing power in any other way causes problems during reloading such as james and improperly loaded cartridges. Attempts to oscillate the drive shaft by power means have not been successfully since it is difficult to duplicate the precise hand control for which the reloader is designed. These and other difficulties experienced with prior attempts to provide power to hand operated firearm cartridge reloaders have been obviated by the present invention.

It is, therefore, a principle object of the invention to provide a drive adapter for a hand operated firearm cartridge reloader which enables the drive shaft of the reloader to be oscillated under power but in full control of the operator.

Another object of this invention is the provision of a drive adapter for a hand operated firearm cartridge reloader which utilizes a fluid oscillator for oscillating the drive shaft of the reloader and control means which enables the operator to manually and selectively control each half of the oscillation of the drive shaft.

A Further object of the present invention is the provision of a drive adaptor for a hand operated firarm cartridge reloader which is adaptable to a plurality of types and models of conventional reloaders.

It is another object of the present invention to provide an adapter for a firearm cartridge reloader which is simple in construction, is reliable and easy to operate.

With these and other objects in view as will be apparent to those skilled in the art, the invention resides in the combination of parts set forth in the specification and covered by the claims appended hereto.

SUMMARY OF THE INVENTION

In general, the invention consists a drive adaptor for a firearm cartridge reloader which includes a double acting fluid oscillator which is driven by a fluid pump and coupling means for operatively connecting the oscillator to the drive shaft of the reloader for providing oscillating motion to the drive shaft. Manually actuated fluid control means are provided for selectively controlling each half of the oscillation of the drive shaft. More specifically, the control means includes electrically actuated valves which are controlled by manually actuated switches.

BRIEF DESCRIPTION OF THE DRAWINGS

The character of the invention, however, may be best understood to reference to one of its structural forms, as illustrated by the accompanying drawings, in which:

FIG. 1 is a front elevational view of a drive adaptor for a reloader which embodies the principals of the present invention and which is shown in driving engagement with the drive shaft of a conventional reloader, only a portion of which is shown for clarity, FIG. 2 is a plan view of the oscillator and coupling portion of the adaptor, FIG. 3 is a vertical cross-sectional view of the oscillator and coupling elements taken on the Line III—III of FIG. 2, FIG. 4 is a vertical cross-sectional view of the oscillator taken on the Line IV—IV of FIG. 2, FIG. 5 is a schematic view of the fluid control portion of the adaptor, and FIG. 6 is a schematic view of the electrical control portion of the reloader.

DESCRIPTION OF THE PREFERRED EMBODIMENT

Referring first to FIG. 1, the drive adaptor of the present invention is generally indicated by the reference numeral 10 and is shown operatively connected to a sequential reloader which is generally indicated by the reference numeral 12, only portions of which are shown for clarity. The reloader 12 includes a horizontal drive shaft 16 which is rotatably mounted on a frame 14. A movable base 18 is mounted to a vertical reciprocation on a pair of vertical guide shafts 20 and contains a plurality of tubular shell supporting fixtures 26 which are vertically aligned with a plurality of complimentary fixtures on a fixed base (not shown) each of the complimentary fixtures on the fixed base represents a station for performing one of several reloading steps. The fixtures 26 are mounted on a carousel base 27 which is mounted for rotation about a vertical axis on the movable base 18 and is indexed one position at a time by indexing means, not shown, for every vertical reciprocation of the movable base 18. The movable base 18 is operatively connected to the drive shaft 16 by a pair of crank connectors 22. The movable base 18 is vertically reciprocated up and down once for every oscillation of the drive shaft 16. For conventional hand operated reloaders, the oscillation of the shaft 16 is accomplished by an elongated actuating lever which is similar to the arm 24 but which is substantially longer. The arm 24 in this particular application is part of a stop mechanism for insuring that the movable base 18 will not be moved beyond the predetermined upper position. The lever 24 swings with the shaft 16 as the shaft oscillates and strikes a front stop 25 when the movable base 18 is in the up position. The movable base 18 strikes a stop 23 when the movable base 18 is in the down position. The stops 23 and 25 are mounted on the frame 14 and are preferably made of a tough thermoplastic material which has a certain degree of yield and resiliency. A wad carrier 19 is pivotally mounted on the left hand guide shaft 20 for movement from a forward loading position to transfer position in which the carrier 19 is in vertical alignment with one of the fixtures 26 and one of the stations of the fixed base.

A shell which is to be reloaded is placed on a starting fixture 21 when the movable base 18 is in the upper position. When the movable base is lowered, the empty shell projects upwardly into whichever one of the fixtures 26 which is vertically aligned with the first station of the fixed base. When the movable base is in the lower position, a wad is placed in the wad carrier 19. When the movable base 18 is reciprocated, the fixtures 26 are indexed one position so that the first shell is vertically aligned with the second station and a second shell is placed on the starting fixture 21. During the next reciprocation of the movable base 18, the fixtures 26 are indexed one again so that the first shell is vertically aligned with the third station, the second shell is vertically aligned with the second station and another fixture 26 is vertically aligned with the first station and ready to receive a third empty shell from the starting fixture 21. This procedure continues until all of the fixtures 26 contain shells which are in various stages of reloading. Thereafter, for each reciprocation of the movable base 18, a completely reloaded cartridge is automatically removed from the reloaded and an empty shell is positioned on the starting fixture.

Referring to FIGS. 1–4, the adaptor 10 comprises a double acting hydraulic oscillator 28 which is operatively connected to the drive shaft 16 by coupling means which is generally indicated by the reference numeral 30. The oscillator 28 and the reloader frame 14 are mounted on a supporting base 32 which insures that the oscillator 28 and the coupling means 30 will be maintained in alignment with the drive shaft 16. The adaptor 10 also includes a motor adaptor assembly which is generally indicated by the reference numeral 34 which is connected to a reservoir of hydraulic fluid 36 and controlled by electrical control means which is generally indicated by the reference numeral 38. The motor adaptor assembly includes a hydraulic pump, an electric motor and valving means to be described. The control means 38 includes a foot actuated rocker arm 39 which is pivoted at 49 on a fixed support 51 and which is maintained in a neutral position by spring 37.

The oscillator 28 comprises a first actuator 42 and a second actuator 44. The first actuator 42 consists of a piston 41 which is slidable within a cylinder 43. The second actuator 44 consists of a piston 45 which is slidable within a cylinder 47. The pistons 41 and 45 are connected to the opposite ends of a toothed rack 46 which is in driving engagement with a gear 48. The gear 48 is keyed to an output shaft 40. The first actuator 42 is connected to the motor adaptor assembly 34 by a hydraulic line 50 and the second actuator 44 is connected to the assembly 34 by a hydraulic line 52. When the hydraulic pump within the assembly 34 is operatively connected to the first actuator 42 the piston 41 is driven inwardly, to the left as viewed in FIG. 4 for rotating the output shaft 40 in a counterclockwise direction as viewed in FIG. 4. During the power stroke of the first actuators 42, the hydraulic fluid within the piston 47 returns to the assembly 34 through the line 52. When the second actuator 44 is operatively connected to the pump within the assembly 34, pressurized hydraulic fluid is delivered to the piston 47 for drving the piston 45 inwardly toward the right as viewed in FIG. 4. This causes a clockwise rotation of the upward shaft 40 as viewed in FIG. 4. The hydraulic fluid within the cylinder 43 is displaced by the piston 41 as the piston 44 is driven inwardly. The displaced hydraulic fluid from the cylinder 43 returns to the motor adaptor assembly 34 through the hydraulic line 50. The coupling means 30 comprises a first gear 29 which is fixed to the output shaft 40 and a second gear 31 which is keyed to the drive shaft 16 of the reloader 12. The gear 31 is driven by the gear 29 through an intermediate gear 35 which is in the shape of a sleeve which has internal gear teeth for engaging the external gear teeth of the gears 29 and 31. The gears 29 and 31 are preferably made of metal while the intermediate gear 35 is preferably out of a tough thermo-plastic material such as nylon. The coupling means 30 enables the reloader of the present invention to be virtually adaptable to a variety of reloaded models and designs which differ in the diameter of the drive shaft 16. A coupling means 30 which is utilized for a drive shaft 16 having a first diameter is nearly identical to a coupling means 30 for a drive shaft 16 having a second diameter, the two coupling means differing only with respect to the drive gear 31. In each case, the bore of the gear 31 has a diameter which is equivalent to the diameter of the drive shaft 16. When the output shaft 40 is driven in a counterclockwise direction, the drive shaft 16 is also driven in a counterclockwise direction when viewed from the right of FIG. 1. When the output shaft 40 is driven in a clockwise direction the drive shaft 16 is also driven in a clockwise direction when viewed from the right of FIG. 1. Counterclockwise rotation of the drive shaft 16 causes the movable frame 18 to be raised to the upper position. Clockwise rotation of the drive shaft 16 causes the movable base 18 to be lowered to its lower position. The rotation of the drive shaft 16 and the subsequent raising and lowering of the movable base 18 is selectively controlled by the motor adaptor assembly 34 and the electrical control means 38. For some reloaders, the drive shaft extends a sufficient distance beyond the left hand bearing of the frame to enable the drive gear 31 to be fixed directly to the original drive shaft. For other reloaders, the original shaft is replaced by shaft which has the same diameter by which is slightly longer and which has a keyway at the end of the shaft.

Referring to FIG. 5, the hydraulic control in the adaptor are diagrammatically shown and include the oscillator 28 and the motor adaptor assembly 34 which is connected to the oscillator 28 by the hydraulic line 50 and 52. To motor adaptor assembly 34 includes a hydraulic pump 56 which is connected to a three position four way cartridge valve 58 by a hydraulic line 57. The cartridge valve 58 includes a first solenoid coil 60, a second solenoid coil 62 and an overload relief valve 64. The hydraulic pump 56 runs constantly for selectively pumping hydraulic fluid through line 50 or line 52 or back to the reservoir 36. When the solenoid coil 60 is energized, hydraulic fluid is pumped through line 50 to the oscillator 28 for driving the piston 41 and hydraulic fluid from the cylinder 47 returns to the valve 58 through the hydraulic line 52. When the solenoid coil 62 is energized, the valve 58 causes hydraulic fluid to be pumped from the pump 56 through the line 52 to the oscillator 28 for actuating the second actuator 44. This causes hydraulic fluid from the cylinder 42 to return to the cartridge valve 58 through the hydraulic line 50. The hydraulic line 52 contains a restrictive valve 66 which enables hydraulic fluid to flow through the line 52 to the oscillator 28 unrestricted during the driving phase of the second actuator through the line 52 but restricts the return flow of the hydraulic fluid through the line 52 when the first actuator 41 is actuated. The restriction of the return fluid from the cylinder 47 affects the actuating speed of the first actuator 42. For some types of reloaders, there is at least one reloading step for which the upward movement of the movable base 18 should not exceed a predetermined maximum speed while the base can be moved downwardly at a greater speed without detriment. By restricting the upward movement of the movable base 18 to its maximum value and allowing the movable base 18 to descend at a greater value, the overall speed of the reloader is not entirely restricted by the upward speed limitation of the movable base 18. In other types of reloaders a critical maximum speed limitation occurs during the downward movement of the movable base while the movable base can be moved upwardly without detriment at a greater maximum speed. In such a case, the restricter value 66 is located in the hydraulic line 50.

Referring to FIG. 6, the electrical controls for the hydraulic elements of the reloader are depicted schematically and include a pair of power lines 69 and 71 which are connected to a source of electrical power 70. An electric motor 72 for driving the pump 56 is located on a line 70 which is connected across the power line 69 and 71. The solenoid coil 60 and 62 are located on lines 73 and 75 in a normally de-energized state. A relay 76 is located on a line 78 and a relay 80 is located on a line 82. A normally open switch 84 is also located on the line 78 and a normally open switch 86 is located on the line 82. When the switch 84 is closed, a circuit is completed across the power line 69 and 71 for energizing the relay 76. When the switch 86 is closed, a circuit is completed across the power line 71 and 69 for energizing the relay 80. When the relay 76 is energized, its normally open contact 88 on line 73 is closed and causes energization of a solenoid 60 which causes hydraulic fluid from the pump 56 to flow to the first actuator 42. When the relay 80 is energized, is normally open contact 90 on line 75 is closed, thereby energizing solenoid coil 62 and causing hydraulic fluid to flow to the second actuator 44 from the pump 56. When neither of the solenoid coils 60 or 62 is energized, the cartridge valve 58 is in a neutral state so that there is no flow of hydraulic fluid toward or from the oscillator 28. The switches 84 and 86 are selectively closed by the manual actuation of the rocker arm 39. The rocker arm 39 is manipulated by the operator's foot. By depressing one side of the rocker arm, the switch 84 is closed. By depresssing the opposite side of the rocker arm, the switch 86 is closed. When the rocker arm 39 is in the neutral position as shown in FIG. 1 both switches 84 and 86 are open and the valve 58 remains in its neutral condition wherein no hydraulic fluid is pumped to the oscillator 28. This selectivity also enables the movable base 18 to be stopped at any point during its upward or downward movement and reversed. This is a very important feature. Although the movement of the movable base 18 is power driven, the movement is under the full control of the operator. If a malfunction occurs during a reloading sequence, the movable base 18 will automatically stop when the operator lifts his or her foot from the rocker arm 39. This also enables the operator to proceed at his or her own pace, the operation being limited primarily by the amount of time it takes to remove a completed cartridge to place an empty cartridge on the starting fixture 21 and to place a wad on the wad carrier 19. However, the movable base 18 is reciprocated under power a great deal faster than is possible with the conventional hand actuated lever so that production is greatly increased. Also, the fatigue factor of hand reloading is eliminated so that an individual can reload a greater number of shells in a shorter amount of time with considerably less effort.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A drive adaptor for a firearm cartridge reloader which includes a frame and a horizontal drive shaft which is mounted on the frame for oscillation about its central longitudinal axis for providing the actuating functions of the reloader, said adaptor comprising:

(a) a fluid pump, (b) a double acting fluid oscillator which has an output shaft and two fluid driven actuating elements, one of said actuating elements being effective to rotate said output shaft in a clockwise direction and the other of said actuating elements being effective to rotate said output shaft in a counter clockwise direction, (c) a base for supporting the reloader and the oscillator so that the oscillator is maintained in a fixed position relative to the reloader, (d) coupling means for operatively connecting said output shaft to said horizontal shaft for clockwise and counter clockwise rotation of said horizontal shaft when viewed from one end, and (e) fluid control means for selectively connecting said actuating elements to said fluid pump for selective clockwise and counterclockwise rotation of said horizontal shaft.

2. A drive adaptor for a frirearm cartridge reloader which includes a frame and a drive shaft which is mounted on the frame for oscillation about its central longitudinal axis to provide the actuating functions for the reloader, said adaptor comprising:

(a) a fluid pump, (b) a double acting fluid oscillator which has an output shaft and two fluid driven actuating elements, one of said actuating elements being effective to rotate said output shaft in a clockwise direction and the other of said actuating element being effective to rotate said output shaft in a counterclockwise direction, (c) coupling means for operatively connecting said output shaft to said horizontal shaft so that rotation of said output shaft causes said horizontal shaft to rotate, said coupling means comprising:

(1) a first gear which is fixed to said output shaft, (2) a second gear which is fixed to said horizontal shaft, and (3) an intermediate gear which is in driving engagement with said first and second gears, and (d) fluid control means for selectively connecting said actuating elements to said fluid pump for selective clockwise and counterclockwise rotation of said horizontal shaft.

3. A drive adapter as recited in claim 2, wherein said output shaft and said horizontal are axially aligned, said first and second gears have external teeth and said intermediate gear is a sleeve which fits over the first and second gears and which has first and second internal teeth for engaging the external teeth of said first and second gears respectively.

4. A drive adapter as recited in claim 3, wherein each of said gears is made of metal and said intermediate gear is made of nylon.

5. A drive adapter for a firearm cartridge reloader which includes a frame and a horizontal drive shaft which is mounted in the frame for oscillation about its central longitudinal axis for providing the actuating functions of the reloader, said adapter comprising:

(a) an electrically driven fluid pump, (b) a double acting fluid oscillator which has an output shaft and two fluid driven actuating elements, one of said actuating elements being effective to rotate said output shaft clockwise when viewed from one end and the other of said actuating elements being effective to rotate said output shaft counterclockwise when viewed from said one end, (c) coupling means for operatively connecting said output shaft to said horizontal shaft for clockwise and counterclockwise rotation of said horizontal shaft when viewed from one end, (d) electrically actuated valving means for selectively connecting said actuating elements to said fluid pump, and (e) manually actuated switch means for selective actuation of said valving means.

6. A drive adapter as recited in claim 5, wherein said valving means is a three position, four way valve which has a normal neutral condition in which neither actuating element of said fluid oscillator is operatively connected to said pump, a first active condition in which said one actuating element is operatively connected to said pump and a second active condition in which said other actuating element is operatively connected to said pump.

7. A drive adapter as recited in claim 6, wherein said valving means has a first electrical coil and a second coil wherein energization of said first electrical coil renders said valving means in said first active condition and energization of said second electrical coil renders said valving means in said second active condition, and wherein, said switch means comprises a first switch for energizing and first electrical coil and a second switch for energizing said second electrical coil.

8. A drive adapter as recited in claim 7, wherein said valving means includes flow control means for causing said output shaft to rotate at a slower rate in one direction relative to the other direction.

9. A drive adapter as recited in claim 8, wherein said flow control means is a restricter valve between said oscillator and said three position four way valve which restricts the return flow from one of said actuating elements and thereby restricting the movement of the other of said actuating elements.

10. A drive adatper as recited in claim 5, wherein said valving means includes a relief valve to prevent the fluid pressure from exceeding a predetermined value.

11. A drive adapter as recited in claim 5, further comprising:

(a) a first stop to prevent said horizontal drive shaft from exceeding a predetermined amount of rotation in said clockwise direction, and (b) a second stop to prevent said horizontal drive shaft from exceeding a predetermined amount of rotation in said counterclockwise direction.

* * * * *